US011756481B2

(12) United States Patent
Kim et al.

(10) Patent No.: US 11,756,481 B2
(45) Date of Patent: Sep. 12, 2023

(54) DYNAMIC VOLTAGE TUNING TO MITIGATE VISUAL ARTIFACTS ON AN ELECTRONIC DISPLAY

(71) Applicant: Apple Inc., Cupertino, CA (US)

(72) Inventors: Hyunsoo Kim, San Diego, CA (US); Kingsuk Brahma, Mountain View, CA (US); Myungjoon Choi, San Jose, CA (US); Yue Jack Chu, Cupertino, CA (US); Li-Xuan Chuo, San Jose, CA (US); Hassan Edrees, Cupertino, CA (US); Chin-Wei Lin, San Jose, CA (US); Hyunwoo Nho, Palo Alto, CA (US); Shinya Ono, Santa Clara, CA (US); Alex H. Pai, Milpitas, CA (US); Jie Won Ryu, Santa Clara, CA (US); Yao Shi, Sunnyvale, CA (US); Chaohao Wang, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/469,816

(22) Filed: Sep. 8, 2021

(65) Prior Publication Data

US 2022/0076627 A1 Mar. 10, 2022

Related U.S. Application Data

(60) Provisional application No. 63/075,779, filed on Sep. 8, 2020.

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0819* (2013.01);
(Continued)

(58) Field of Classification Search
CPC ..... G09G 3/3233; G09G 3/3266; G09G 2300/0819; G09G 2300/0842; G09G 2300/04; G09G 2320/0247; G09G 2320/041; G09G 2320/0626; G09G 2340/435; G09G 2360/12
See application file for complete search history.

(56) References Cited

U.S. PATENT DOCUMENTS

2006/0077138 A1* 4/2006 Kim ..... G09G 3/325 345/76
2006/0108937 A1* 5/2006 Kim ..... G09G 3/3233 315/169.3

(Continued)

*Primary Examiner* — David Tung
(74) *Attorney, Agent, or Firm* — Fletcher Yoder, P.C.

(57) ABSTRACT

Systems, methods, and devices are provided for mitigating visual artifacts by dynamically tuning bias voltages applied to display pixels. An electronic display may include a display pixel and a bias voltage supply. The bias voltage supply may supply a first bias voltage to the display pixel for a first subframe of a frame of image data. The bias voltage supply may supply a different second bias voltage to the display pixel for a second subframe of the frame of image data. This may mitigate certain image artifacts, such as flicker or variable refresh rate luminance difference, that could arise due to display pixel hysteresis that varies across subframes of the image frame.

18 Claims, 10 Drawing Sheets

(52) U.S. Cl.
CPC ..... *G09G 2300/0842* (2013.01); *G09G 2320/0247* (2013.01); *G09G 2320/041* (2013.01); *G09G 2320/0626* (2013.01); *G09G 2360/12* (2013.01)

(56) References Cited

U.S. PATENT DOCUMENTS

| | | | | |
|---|---|---|---|---|
| 2007/0126673 | A1 | 6/2007 | Djordjev et al. | |
| 2007/0279345 | A1* | 12/2007 | Kim | G09G 3/3233 345/80 |
| 2009/0303207 | A1 | 12/2009 | Ng | |
| 2012/0200554 | A1 | 8/2012 | Kim et al. | |
| 2014/0218415 | A1* | 8/2014 | Pak | G09G 3/3291 345/212 |
| 2014/0292826 | A1* | 10/2014 | In | G09G 3/2022 345/690 |
| 2015/0015557 | A1* | 1/2015 | Kim | G09G 3/3233 345/76 |
| 2015/0243219 | A1* | 8/2015 | In | G09G 3/2081 345/212 |
| 2016/0329017 | A1 | 11/2016 | Chaji et al. | |
| 2017/0162127 | A1* | 6/2017 | Park | G09G 3/3233 |

* cited by examiner

DYNAMIC VOLTAGE TUNING TO MITIGATE VISUAL ARTIFACTS ON AN ELECTRONIC DISPLAY

CROSS-REFERENCE TO RELATED APPLICATIONS

This application claims the benefit of U.S. Provisional Application Ser. No. 63/075,779, entitled "Dynamic Voltage Tuning to Mitigate Visual Artifacts on an Electronic Display," filed Sep. 8, 2020, which is hereby incorporated by reference in its entirety for all purposes.

SUMMARY

This disclosure relates to dynamic voltage tuning to mitigate visual artifacts that may appear on an electronic display under lower refresh rates.

A summary of certain embodiments disclosed herein is set forth below. It should be understood that these aspects are presented to provide the reader with a brief summary of these certain embodiments and that these aspects are not intended to limit the scope of this disclosure.

Electronic displays may be found in numerous electronic devices, from mobile phones to computers, televisions, automobile dashboards, and augmented reality or virtual reality glasses, to name just a few. Electronic displays with self-emissive display pixels produce their own light. Self-emissive display pixels may include any suitable light-emissive elements, including light-emitting diodes (LEDs) such as organic light-emitting diodes (OLEDs) or micro-light-emitting diodes (μLEDs). By causing different display pixels to emit different amounts of light, individual display pixels of an electronic display may collectively produce images.

To save power, the electronic display may be refreshed with new image data at relatively lower refresh rates when the imagery on the electronic display will change relatively slowly. For example, when an electronic display is displaying a document or e-book, the image data may be refreshed at a lower rate than when the electronic display is displaying a movie or game. After a frame of image data has been programmed into the display pixels of the electronic display, the electronic display may emit the programmed amount of light from each display pixel over several subframes. For example, rather than emitting the light over the entire duration of the image frame, which may have a relatively long duration if the refresh rate is low, the image frame may be divided into subframes. Between each subframe, the display pixels may stop emitting light for a very brief moment while certain bias voltages are applied to the display pixels. This may prevent the amount of light from drifting from subframe to subframe. By keeping a consistent average amount of light emitted in each subframe, image artifacts such as flickering may be reduced.

Under some conditions, particularly lower refresh rates or lower luminances, hysteresis in transistors of the display pixels could cause the amount of light emitted to vary noticeably from subframe to subframe. Dynamically tuning the bias voltages applied to the transistors in between subframes may counteract these hysteresis effects. Because the hysteresis effects may vary over time, different bias voltages may be selected for different subframes. For example, a first subframe may have a first bias voltage, a second subframe may have a second bias voltage, and so forth.

The bias voltages may be determined through calibration by testing different bias voltages for different conditions to reduce or eliminate image artifacts, such as flicker or variable refresh rate luminance differences. Different conditions that may be considered include, among other things, a current display panel temperature, a current global brightness setting, a current refresh rate, properties of the image content of the image frame to be displayed on the electronic display, display panel age, and so forth. Once calibration has been used to determine the bias voltages for different conditions, the bias voltages may be stored and used by the electronic display while in operation.

The bias voltages may be stored in a lookup table on a display driver integrated circuit (DIC). The lookup table may take any suitable form. In one example, the lookup table may be a two-dimensional lookup table that receives a current global brightness setting and a current display panel temperature and outputs a sequence of bias voltages for those conditions. When the sequence of bias voltages is applied to display pixels for a corresponding sequence of subframes, the display pixel hysteresis effects may be counteracted and display artifacts may be reduced or eliminated.

BRIEF DESCRIPTION OF THE DRAWINGS

Various aspects of this disclosure may be better understood upon reading the following detailed description and upon reference to the drawings described below.

DETAILED DESCRIPTION

Figure 1:
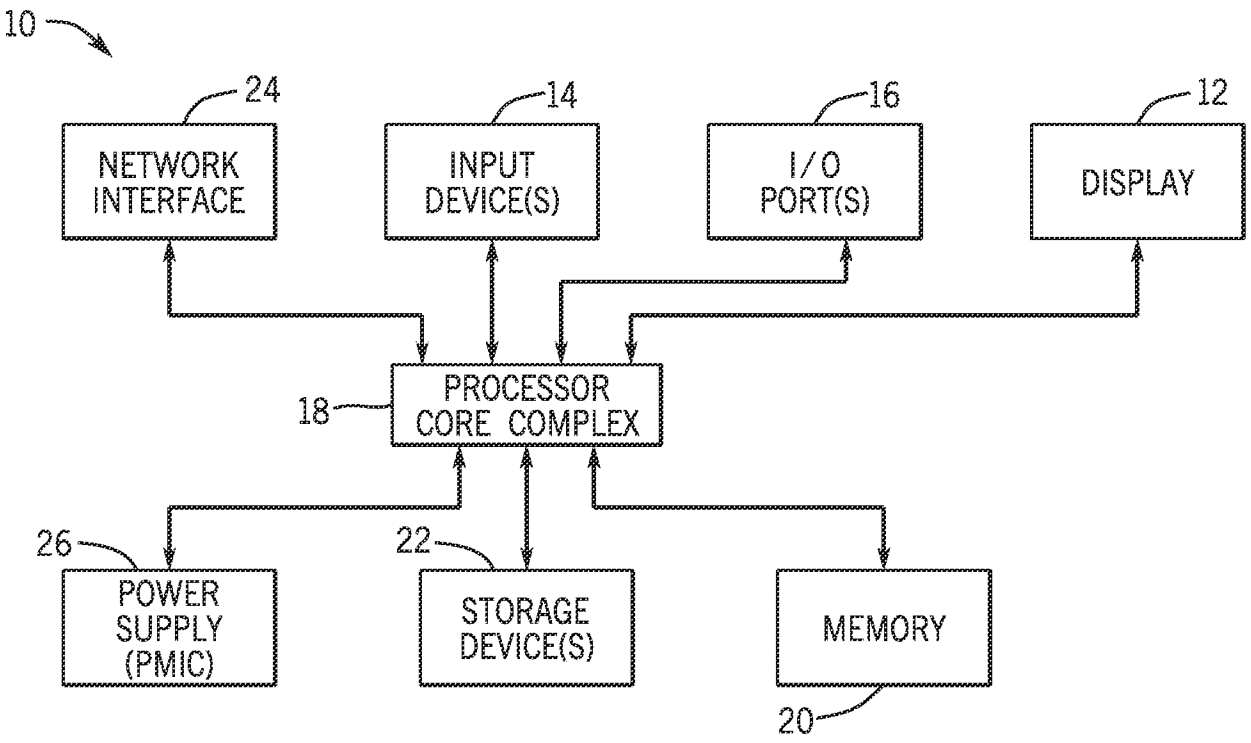
FIG. 1 is a schematic block diagram of an electronic device, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "including" and "having" are intended to be inclusive and mean that there may be additional elements other than the listed elements. Additionally, it should be understood that references to "some embodiments," "embodiments," "one embodiment," or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

This disclosure relates to electronic displays that use dynamic bias voltages to prevent luminance drift during an image frame, particularly at low refresh rates. This may reduce or eliminate certain image artifacts, such as flicker or variable refresh rate luminance difference. As mentioned above, electronic displays may be found in numerous electronic devices, from mobile phones to computers, televisions, automobile dashboards, and augmented reality or virtual reality glasses, to name just a few. To save power, an electronic display may be refreshed with new image data at relatively lower refresh rates when the imagery on the electronic display will change relatively slowly. A single image frame at a low refresh rate may be divided into multiple faster subframes. Between each subframe, the display pixels may stop emitting light for a very brief moment while certain bias voltages are applied to the display pixels. The bias voltages may include, for example, an on-bias stress bias voltage Vbias applied to a driving transistor and/or an anode reset voltage Vreset applied to an OLED.

Dynamically adjusting these bias voltages may cause the display pixels to emit light more uniformly from subframe to subframe. It is believed that this is because, particularly for lower refresh rates or lower luminances, hysteresis in transistors (e.g., driving transistors) or light emitting diodes (e.g., organic light emitting diodes (OLEDs)) of the display pixels could cause the amount of light emitted to noticeably vary from subframe to subframe. Dynamically adjusting the bias voltages that are applied to the transistors between subframes may counteract these hysteresis effects. Because the hysteresis effects may vary over time, different bias voltages may be selected for different subframes. Notably, in some cases, the bias voltages that are applied in one subframe may differ from the bias voltages applied in a subsequent subframe. This may prevent the amount of light from drifting from subframe to subframe. By keeping a consistent average amount of light emitted in each subframe, image artifacts such as flickering may be reduced.

With this in mind, an example of an electronic device 10, which includes an electronic display 12 that may benefit from these features, is shown in FIG. 1. The electronic device 10 may be any suitable electronic device, such as a computer, a mobile (e.g., portable) phone, a portable media device, a tablet device, a television, a handheld game platform, a personal data organizer, a virtual-reality headset, a mixed-reality headset, a vehicle dashboard, and/or the like. Thus, it should be noted that FIG. 1 is merely one example of a particular implementation and is intended to illustrate the types of components that may be present in an electronic device 10.

In addition to the electronic display 12, as depicted, the electronic device 10 includes one or more input devices 14, one or more input/output (I/O) ports 16, a processor core complex 18 having one or more processors or processor cores and/or image processing circuitry, memory 20, one or more storage devices 22, a network interface 24, and a power supply 26. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the memory 20 and the storage devices 22 may be included in a single component. Additionally or alternatively, image processing circuitry of the processor core complex 18 may be disposed as a separate module or may be disposed within the electronic display 12.

The processor core complex 18 is operably coupled with the memory 20 and the storage device 22. As such, the processor core complex 18 may execute instructions stored in memory 20 and/or a storage device 22 to perform operations, such as generating or processing image data. The processor core complex 18 may include one or more microprocessors, one or more application specific processors (ASICs), one or more field programmable logic arrays (FPGAs), or any combination thereof.

In addition to instructions, the memory 20 and/or the storage device 22 may store data, such as image data. Thus, the memory 20 and/or the storage device 22 may include one or more tangible, non-transitory, computer-readable media that store instructions executable by processing circuitry, such as the processor core complex 18, and/or data to be processed by the processing circuitry. For example, the memory 20 may include random access memory (RAM) and the storage device 22 may include read only memory (ROM), rewritable non-volatile memory, such as flash memory, hard drives, optical discs, and/or the like.

The network interface 24 may enable the electronic device 10 to communicate with a communication network and/or another electronic device 10. For example, the network interface 24 may connect the electronic device 10 to a personal area network (PAN), such as a Bluetooth network, a local area network (LAN), such as an 802.11x Wi-Fi network, and/or a wide area network (WAN), such as a 4G, LTE, or 5G cellular network. In other words, the network interface 24 may enable the electronic device 10 to transmit data (e.g., image data) to a communication network and/or receive data from the communication network.

The power supply 26 may provide electrical power to operate the processor core complex 18 and/or other components in the electronic device 10, for example, via one or more power supply rails. Thus, the power supply 26 may include any suitable source of electrical power, such as a rechargeable lithium polymer (Li-poly) battery and/or an alternating current (AC) power converter. A power management integrated circuit (PMIC) may control the provision and generation of electrical power to the various components of the electronic device 10.

The I/O ports 16 may enable the electronic device 10 to interface with another electronic device 10. For example, a portable storage device may be connected to an I/O port 16, thereby enabling the electronic device 10 to communicate data, such as image data, with the portable storage device.

The input devices 14 may enable a user to interact with the electronic device 10. For example, the input devices 14 may include one or more buttons, one or more keyboards, one or more mice, one or more trackpads, and/or the like. Additionally, the input devices 14 may include touch sensing components implemented in the electronic display 12. The touch sensing components may receive user inputs by detecting occurrence and/or position of an object contacting the display surface of the electronic display 12.

In addition to enabling user inputs, the electronic display 12 may facilitate providing visual representations of information by displaying one or more images (e.g., image frames or pictures). For example, the electronic display 12 may display a graphical user interface (GUI) of an operating system, an application interface, text, a still image, or video content. To facilitate displaying images, the electronic display 12 may include a display panel with one or more display pixels. The display pixels may represent sub-pixels that each control a luminance of one color component (e.g., red, green, or blue for an RGB pixel arrangement).

The electronic display 12 may display an image by controlling the luminance of its display pixels based at least in part image data associated with corresponding image pixels in image data. In some embodiments, the image data may be generated by an image source, such as the processor core complex 18, a graphics processing unit (GPU), an image sensor, and/or memory 20 or storage 22. Additionally, in some embodiments, image data may be received from another electronic device 10, for example, via the network interface 24 and/or an I/O port 16.

Figure 2:
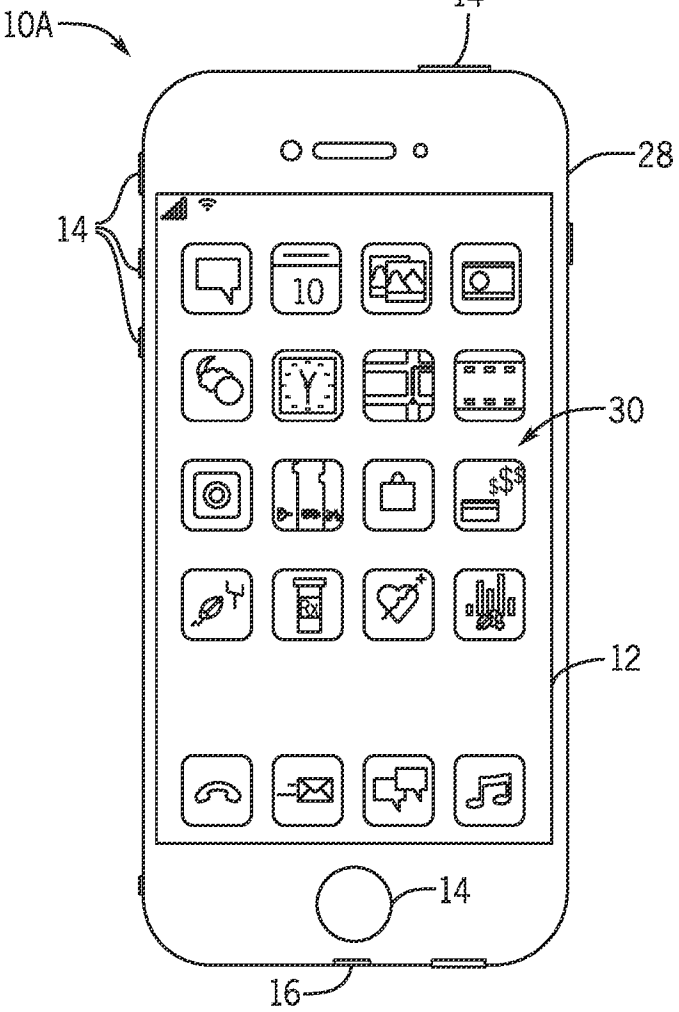
FIG. 2 is a front view of a mobile phone representing an example of the electronic device of FIG. 1, in accordance with an embodiment.

One example of the electronic device 10, specifically a handheld device 10A, is shown in FIG. 2. The handheld device 10A may be a portable phone, a media player, a personal data organizer, a handheld game platform, and/or the like. For example, the handheld device 10A may be a smart phone, such as any iPhone® model available from Apple Inc.

The handheld device 10A includes an enclosure 28 (e.g., housing). The enclosure 28 may protect interior components from physical damage and/or shield them from electromagnetic interference. In the depicted embodiment, the electronic display 12 is displaying a graphical user interface (GUI) 30 having an array of icons 32. By way of example, when an icon 32 is selected either by an input device 14 or a touch sensing component of the electronic display 12, an application program may launch.

Input devices 14 may be provided through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. The I/O ports 16 also open through the enclosure 28. The I/O ports 16 may include, for example, a Lightning® or Universal Serial Bus (USB) port.

Figure 3:
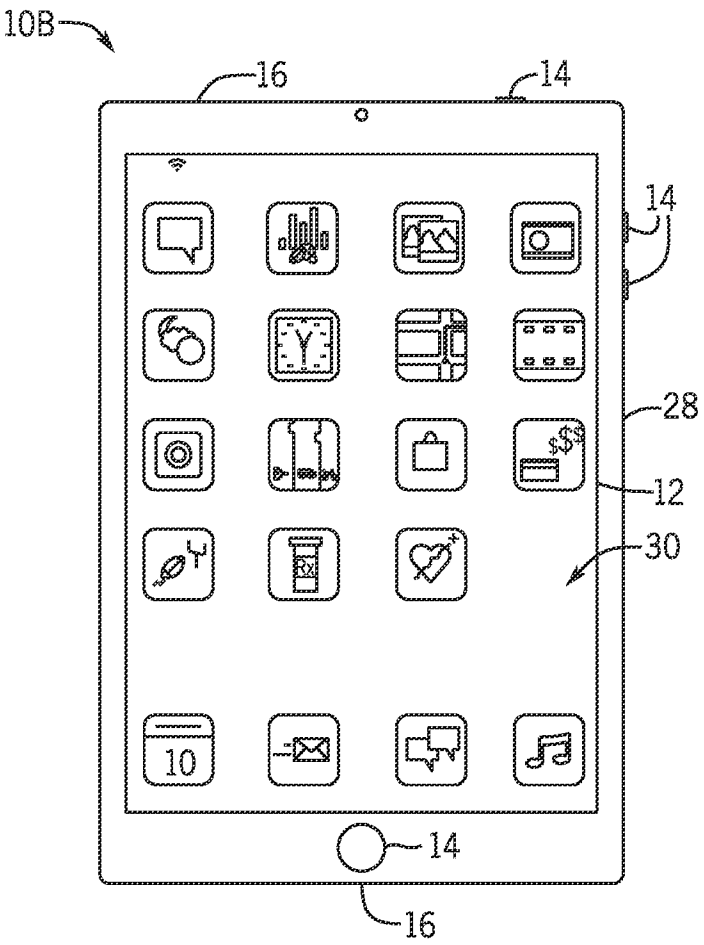
FIG. 3 is a front view of a tablet device representing an example of the electronic device of FIG. 1, in accordance with an embodiment.
Figure 4:
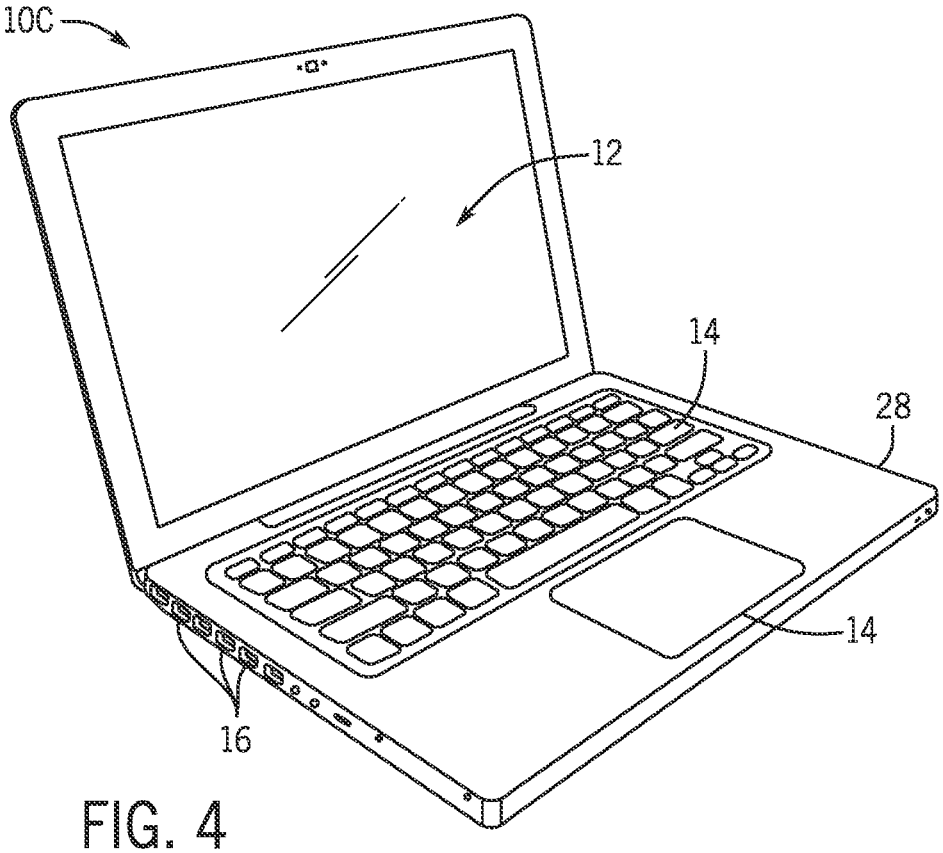
FIG. 4 is a front view of a notebook computer representing an example of the electronic device of FIG. 1, in accordance with an embodiment.
Figure 5:
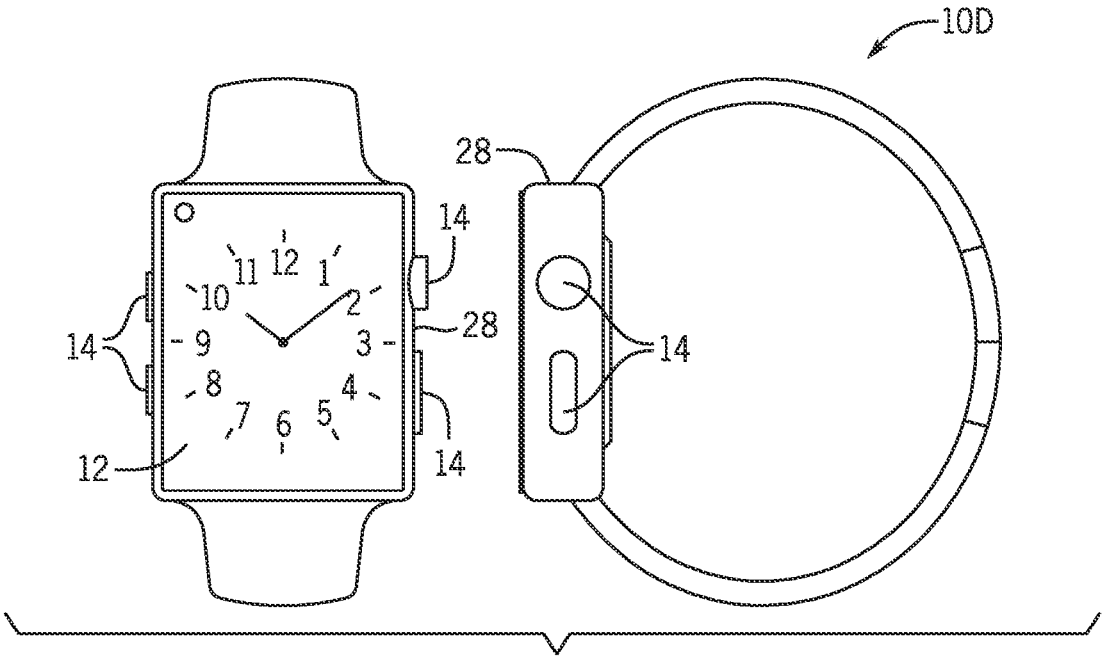
FIG. 5 are front and side views of a watch representing an example of the electronic device of FIG. 1, in accordance with an embodiment.

The electronic device 10 may take the form of a tablet device 10B, as shown in FIG. 3. By way of example, the tablet device 10B may be any iPad® model available from Apple Inc. A further example of a suitable electronic device 10, specifically a computer 10C, is shown in FIG. 4. By way of example, the computer 10C may be any MacBook® or iMac® model available from Apple Inc. Another example of a suitable electronic device 10, specifically a watch 10D, is shown in FIG. 5. By way of example, the watch 10D may be any Apple Watch® model available from Apple Inc. As depicted, the tablet device 10B, the computer 10C, and the watch 10D all include respective electronic displays 12, input devices 14, I/O ports 16, and enclosures 28.

Figure 6:
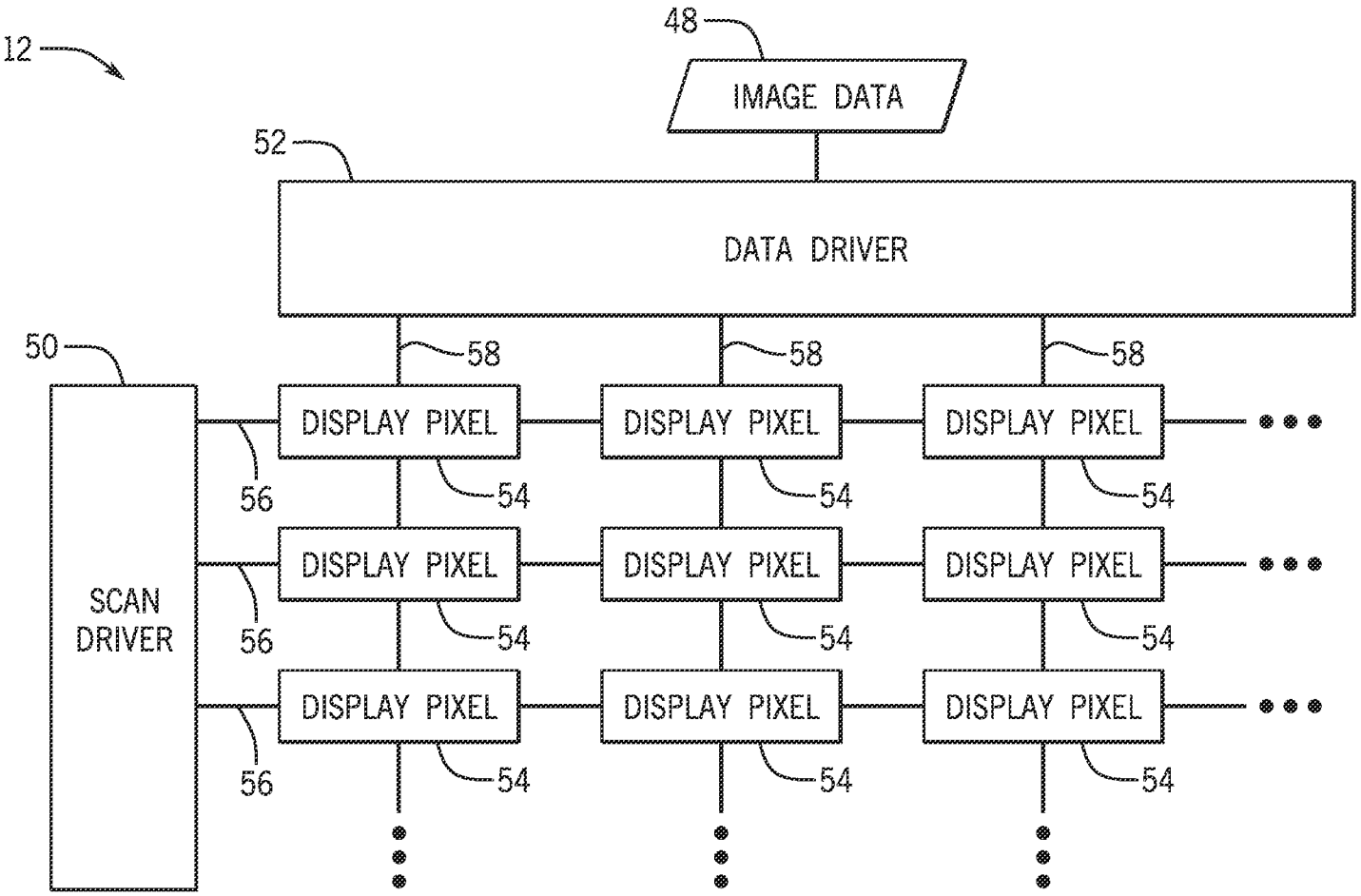
FIG. 6 is a block diagram of an electronic display of the electronic device, in accordance with an embodiment.

As shown in FIG. 6, the electronic display 12 may receive image data 48 for display on the electronic display 12. The electronic display 12 includes display driver circuitry that includes scan driver circuitry 50 and data driver circuitry 52 that can program the image data 48 onto display pixels 54. The display pixels 54 may each contain one or more self-emissive elements, such as a light-emitting diodes (LEDs) (e.g., organic light emitting diodes (OLEDs) or micro-LEDs (μLEDs)). Different display pixels 54 may emit different colors. For example, some of the display pixels 54 may emit red light, some may emit green light, and some may emit blue light. Thus, the display pixels 54 may be driven to emit light at different brightness levels to cause a user viewing the electronic display 12 to perceive an image formed from different colors of light. The display pixels 54 may also correspond to hue and/or luminance levels of a color to be emitted and/or to alternative color combinations, such as combinations that use cyan (C), magenta (M), or others.

The scan driver 50 may provide scan signals (e.g., pixel reset, data enable, on-bias stress) on scan lines 56 to control the display pixels 54 by row. For example, the scan driver 50 may cause a row of the display pixels 54 to become enabled to receive a portion of the image data 48 from data lines 58 from the data driver 52. In this way, an image frame of image data 48 may be programmed onto the display pixels 54 row by row. Other examples of the electronic display 12 may program the display pixels 54 in groups other than by row.

Figure 7:
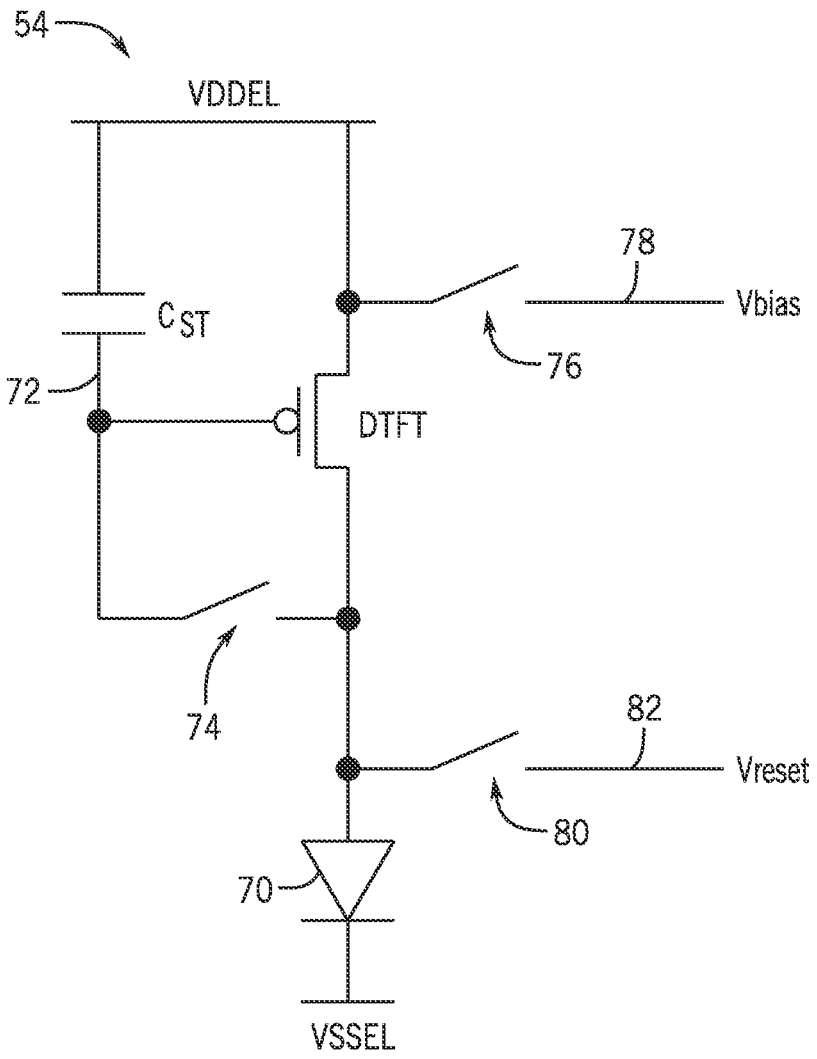
FIG. 7 is a circuit diagram of a display pixel of the electronic display, in accordance with an embodiment.

The display pixels 54 may use any suitable circuitry. A simplified example of a display pixel 54 appears in FIG. 7. The display pixel 54 of FIG. 7 includes an organic light emitting diode (OLED) 70 that emits an amount of light that varies depending on the electrical current through the OLED 70. A driving transistor DTFT provides this electrical current. The electrical current thus varies depending on a programming voltage at a node 72 stored in a storage capacitor $C_{ST}$. The programming voltage at the node 72 is based on the image data and is applied to a gate of the driving transistor DTFT. This causes the driving transistor DTFT to permit a particular amount of current to flow from a positive electroluminance supply voltage VDDEL and a negative electroluminance supply voltage VSSEL through the OLED 70. In this way, the image data 48 may be programmed into the display pixel 54. Before continuing, it is noted that the driving transistor DTFT appears in FIG. 7 as a low-temperature polysilicon (LTPS) PMOS transistor. However, the driving transistor DTFT may take any suitable form, such as an LTPS or LTPO PMOS, NMOS, or CMOS transistor.

The programming voltage may be stored onto the storage capacitor $C_{ST}$ through a switch 74 that may be selectively opened and closed. The switch 74 is closed during programming at the start of an image frame to allow the programming voltage to be stored in the storage capacitor $C_{ST}$. After the programming voltage to be stored in the storage capacitor $C_{ST}$, the switch 74 may be opened. The switch 74 thus may represent any suitable transistor (e.g., an LTPS or LTPO transistor) with sufficiently low leakage to sustain the programming at the lowest refresh rate used by the electronic display 12. A switch 76 may selectively provide a bias voltage Vbias from a first bias voltage supply 78. A switch 80 may selectively provide an anode reset voltage Vreset through a second bias voltage supply 82. The switches 76 and 80 may likewise take the form of any suitable transistors (e.g., LTPS or LTPO PMOS, NMOS, or CMOS transistors).

To save power, the electronic display 12 may be refreshed with new image data at relatively lower refresh rates when possible. For example, when the image data corresponds to a document or e-book, the image data 48 may be refreshed at a lower refresh rate (e.g., more than 1 Hz, 1 Hz, 10 Hz, 30 Hz, 60 Hz), whereas when the image data corresponds to a frame of a movie, game, or movement on a graphical user interface, the image data may be refreshed at a higher refresh rate (e.g., 24 Hz, 30 Hz, 60 Hz, 120 Hz, 240 Hz). In some cases, the electronic display 12 may not have an indication beforehand when the next frame of image data will arrive, and therefore the refresh rate may depend on how often the electronic display 12 receives subsequent frames of image data. Additionally or alternatively, the electronic display 12 may receive instructions to display an image frame of image data for some designated period of time or starting at a particular start time before displaying a subsequent image frame of image data on the electronic display 12.

Figure 8:
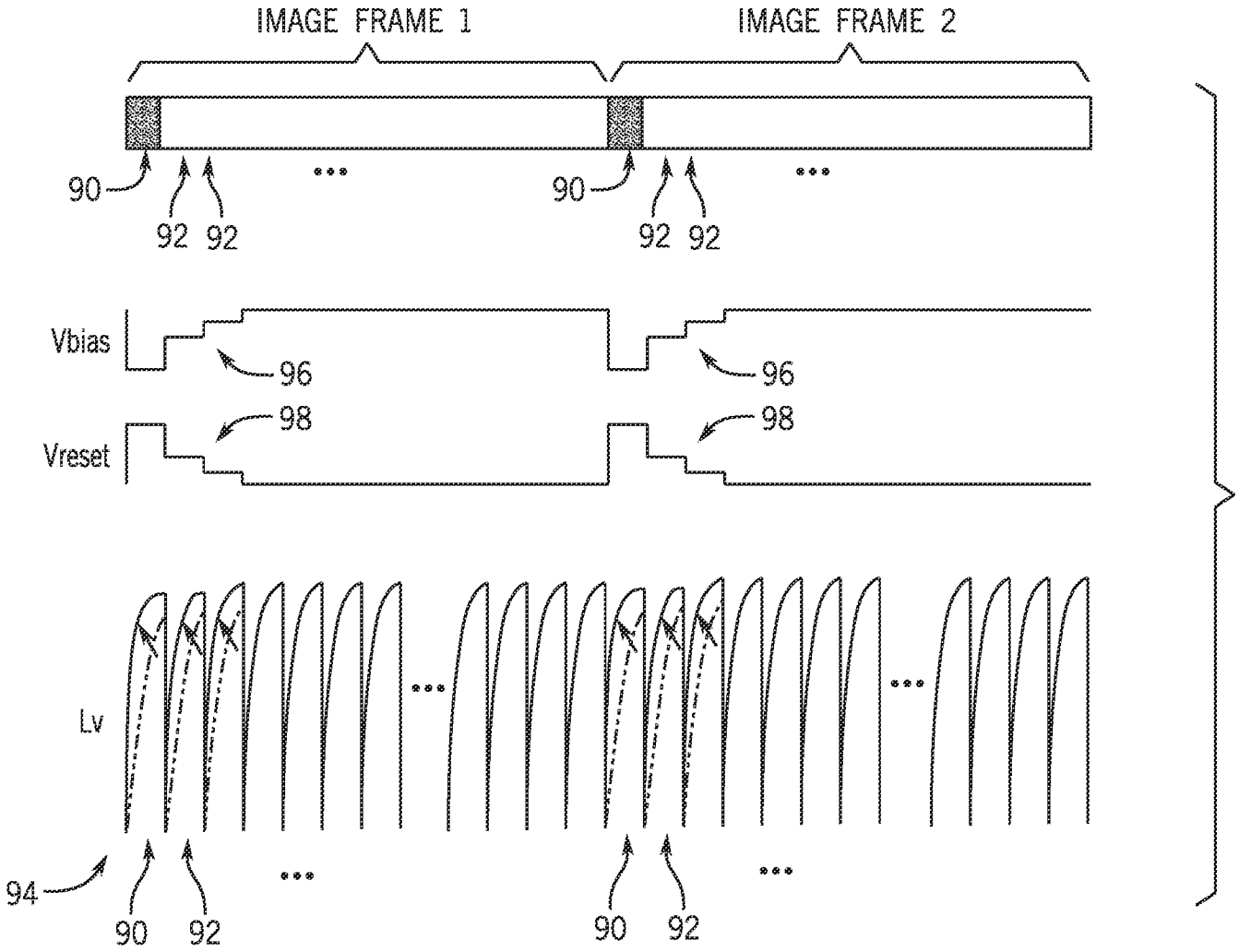
FIG. 8 is a timing diagram for operating the display pixel of FIG. 7 with dynamic bias voltages to reduce display pixel hysteresis and improve the uniformity of light emission from the display pixel, in accordance with an embodiment.

In general, once a frame of the image data is programmed into the display pixels 54 of the electronic display 12, the electronic display 12 may emit the programmed amount of light from each display pixel 54 over several subframes. This results in many quick emissions of light that, when interpreted by the human eye, average over time to appear as a constant amount of light. One example is shown in FIG. 8. In the particular example of FIG. 8, a display pixel 54 (e.g., the display pixel 54 of FIG. 7) is programmed with the same image data for a first frame of the image data (Image Frame 1) and during a second frame of the image data (Image Frame 2). However, the systems and methods of this disclosure also apply when different image data is programmed for different image frames.

At a relatively lower refresh rate, Image Frame 1 and Image Frame 2 may be divided into an initial active subframe 90 where image data is programmed and many subsequent blanking subframes 92 where the image data does not change. Each subframe 90 and 92 may be much shorter than the total time that Image Frame 1 or Image Frame 2 is displayed on the electronic display 12. In one example, Image Frame 1 and Image Frame 2 may each take place at relatively low rates such as 1 Hz (1 s each) or 10 Hz (100 ms each), while the subframes 90 and 92 may take place at higher rates such as 60 HZ (16.66 ms each), 120 Hz (8.33 ms each), or 240 Hz (4.16 ms each). In some cases, the frequency of the subframes 90 and 92 may remain constant (e.g., 120 Hz or 240 Hz), while the frequency of image frames varies, by adding or subtracting blanking subframes 92.

An instantaneous luminance (Lv) 94 may vary over the course of each subframe 90 and 92. Due at least in part to the dynamic application of bias voltage values Vbias 96 and Vreset 98, the average light emission of each subframe 90 and 92 of Image Frame 1 may be substantially the same. Indeed, the solid lines of the instantaneous luminance (Lv) 94 represent the light emitted when particular values of Vbias 96 and Vreset 98 are applied in between subframes. By contrast, the dashed lines represent the resulting light emission if constant values of Vbias 96 and Vreset 98 that do not change from subframe to subframe were used. As can be seen by the change from the dashed-line luminance and the solid-line luminance, applying particular values of Vbias 96 and Vreset 98 for different subframes 90 and 92 causes the luminance of each subframe 90 and 92 throughout the entire image frame.

In other words, when constant values of Vbias 96 and Vreset 98 that do not change from subframe to subframe are used, the light emitted in the initial several subframes 90 and 92 may gradually increase or decrease (shown by the dashed lines of instantaneous luminance (Lv) 94) until stabilizing. But because the initial luminance of the first few subframes is different from the later subframes, the human eye may perceive a flickering visual artifact. Likewise, depending on the refresh rate of the overall image frame, the proportion of initial subframes with different luminance as compared to the later image frames with stable luminance may vary. This may result in different average luminances that vary depending on the overall refresh rate of the image frames. For example, a quicker refresh rate may have fewer total subframes than a slower refresh rate, so any luminance differences among some number of initial subframes may have a greater impact on the average luminance of the higher refresh rate. Consider an example where the initial few subframes of an image frame are darker than the remaining subframes of the image frame. In this case, the longer the image frame, the more remaining full-brightness subframes there are in the image frame compared to the darker initial subframes. Therefore, in this example, the longer the image frame, the brighter the average luminance of the image frame. This may result in a visual artifact as the refresh rate changes unless these effects are counteracted.

Accordingly, different bias voltage values Vbias 96 and Vreset 98 may be respectively supplied on the first bias voltage supply 78 and the second bias voltage supply 82 for different subframes 90 and 92. In the example shown in FIG. 8, the bias voltage Vbias 96 starts relatively lower for the initial active subframe 90 and gradually increases for subsequent blanking subframes 92. Likewise, the bias voltage Vreset 98 may start relatively higher for the initial active subframe 90 and gradually decrease for subsequent blanking subframes 92. The specific bias voltage values Vbias 96 and Vreset 98 may be selected based on any suitable calibration and may vary depending on any suitable conditions or parameters. These may include, among other things, a current display panel temperature, a current global brightness setting, a current refresh rate, properties of the image content of the image frame to be displayed on the electronic display, display panel age, and so forth. Once calibration has been used to determine the bias voltage values for different conditions, the bias voltage values may be stored and used by the electronic display while in operation.

Figure 9:
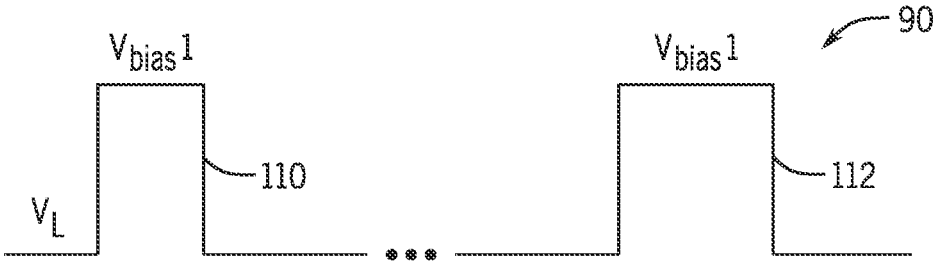
FIG. 9 is an example timing diagram for applying the dynamic bias voltages for an active subframe corresponding to an initial subframe for which image data is programmed into the display pixel, in accordance with an embodiment.

The bias voltage values Vbias 96 and Vreset 98 may be applied during very short intervals in between the subframes. For example, as shown in FIG. 9, a first bias voltage value for Vbias may be applied by briefly closing the switch 76 at the start of the initial active subframe 90 for a pulse 110 before the display pixel 54 begins to emit light and by briefly closing the switch 76 at the end of the initial active subframe 90 for a pulse 112 after the display pixel 54 stops emitting light. The pulses 110 and 112 may take place over a very short timeframe in relation to the total duration of the initial active subframe 90. For example, the pulses 110 and 112 may be on the order of a few microseconds to a few hundred microseconds. In some examples, the pulse 110 may be shorter in duration than the pulse 112 (e.g., in a ratio of 1:1.1, 1:1.5, 1:2, 1:2.5, 1:5, 1:10, 1:25). There may also be more or fewer pulses than shown. Additionally or alternatively, the pulses 110 or 112 may be applied both at the start of the initial active subframe 90 or both at the end of the initial active subframe 90.

Figure 10:
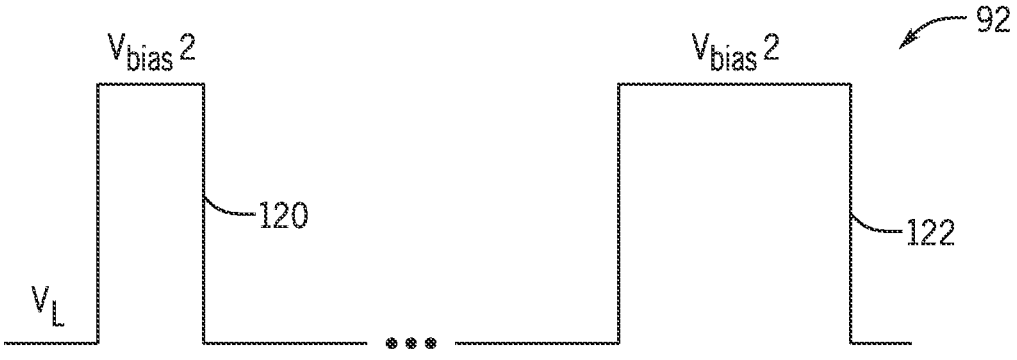
FIG. 10 is an example timing diagram for applying the dynamic bias voltages for a blanking subframe corresponding to a subsequent subframe occurring after the initial active subframe, in accordance with an embodiment.

In another example shown in FIG. 10, a second bias voltage value for Vbias may be applied for the blanking subframe 92 that follows the initial active subframe 90. For example, a second bias voltage value for Vbias may be applied by briefly closing the switch 76 at the start of the blanking subframe 92 for a pulse 120 before the display pixel 54 begins to emit light and by briefly closing the switch 76 at the end of the blanking subframe 92 for a pulse 122 after the display pixel 54 stops emitting light. The pulses 120 and 122 may also take place over a very short timeframe in relation to the total duration of the blanking subframe 92. In some embodiments, the duration of pulses 120 and 122 that are used for blanking subframes 92 may differ from those of the pulses 110 and 112. The pulses 120 and 122 may be on the order of a few microseconds to a few hundred microseconds. In some examples, the pulse 120 may be shorter in duration than the pulse 122 (e.g., in a ratio of 1:1.1, 1:1.5, 1:2, 1:2.5, 1:5, 1:10, 1:25). There may also be more or fewer pulses than shown. Additionally or alternatively, the pulses 120 or 122 may be applied both at the start of the blanking subframe 92 or both at the end of the blanking subframe 92. It should be understood that similar pulses of Vreset may be applied during the initial active subframe 90 and subsequent blanking subframes 92 using the switch 80. Pulses of Vreset may be applied simultaneously with or at the same or different times from the pulses of Vbias.

Figure 11:
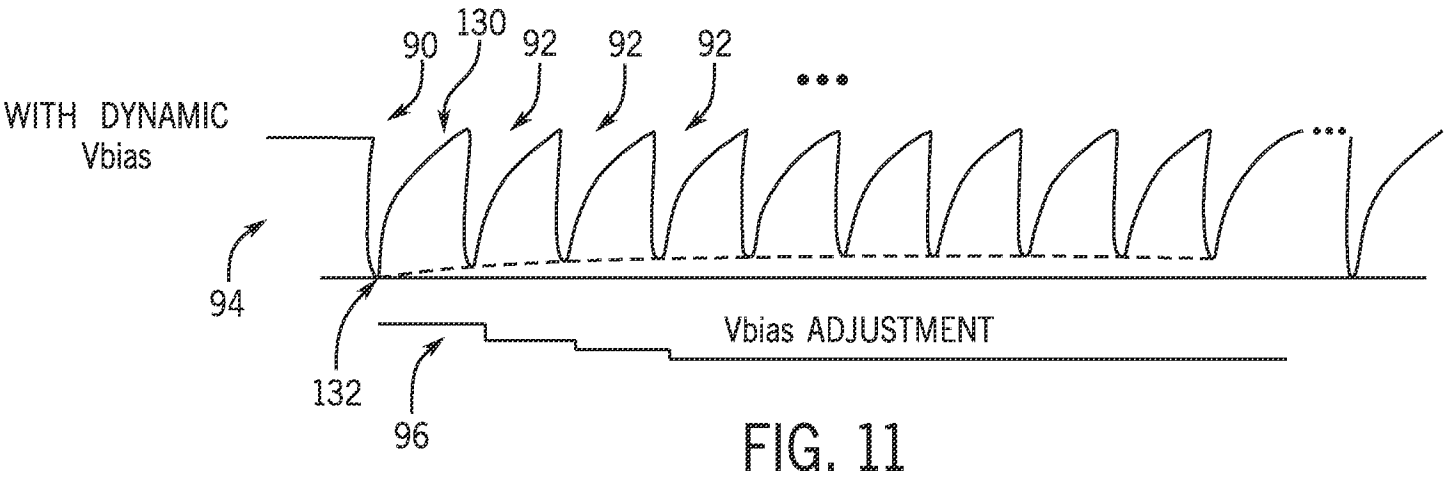
FIG. 11 is a timing diagram for operating the display pixel of FIG. 7 using a dynamic bias voltage to counteract hysteresis in a driving transistor of the display pixel to improve the uniformity of light maximum light emission in each subframe, in accordance with an embodiment.
Figure 12:
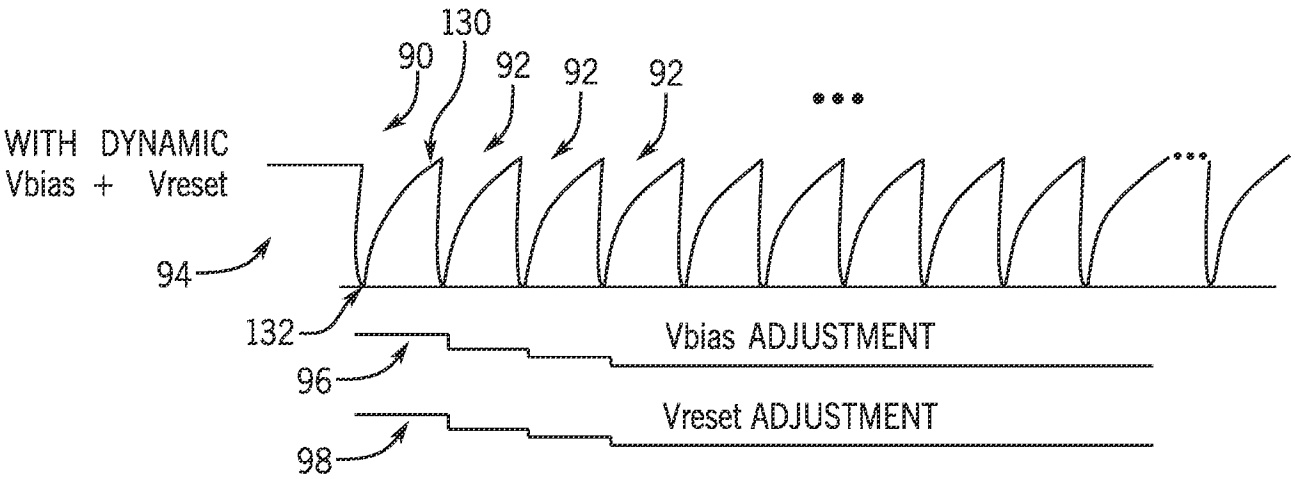
FIG. 12 is a timing diagram for operating the display pixel of FIG. 7 using the dynamic bias voltage as well as a dynamic reset voltage to counteract hysteresis in an organic light emitting diode (OLED) of the display pixel to also improve the uniformity of a minimum light emission in each subframe, in accordance with an embodiment.

It is believed that variations in light output may be due to a variable amount of hysteresis from circuit components of the display pixel 54. For example, Vbias may counteract hysteresis of the driving transistor DTFT, while Vreset may counteract hysteresis of the OLED 70. As shown in FIG. 11, applying a dynamic Vbias voltage 96 to different subframes 90 and 92 may cause a maximum subframe light emission 130 of the instantaneous luminance (Lv) 94 to be more constant across all of the subframes 90 and 92 of an image frame. FIG. 11 also shows that, by contrast, a minimum subframe light emission 132 of the instantaneous luminance (Lv) 94 may not be constant across all of the subframes 90 and 92 of an image frame when a dynamic Vreset voltage 98 is not applied. As shown in FIG. 12, however, the minimum subframe light emission 132 of the instantaneous luminance (Lv) 94 may be more constant across all of the subframes 90 and 92 of an image frame when a dynamic Vreset voltage 98 is also applied.

Figure 13:
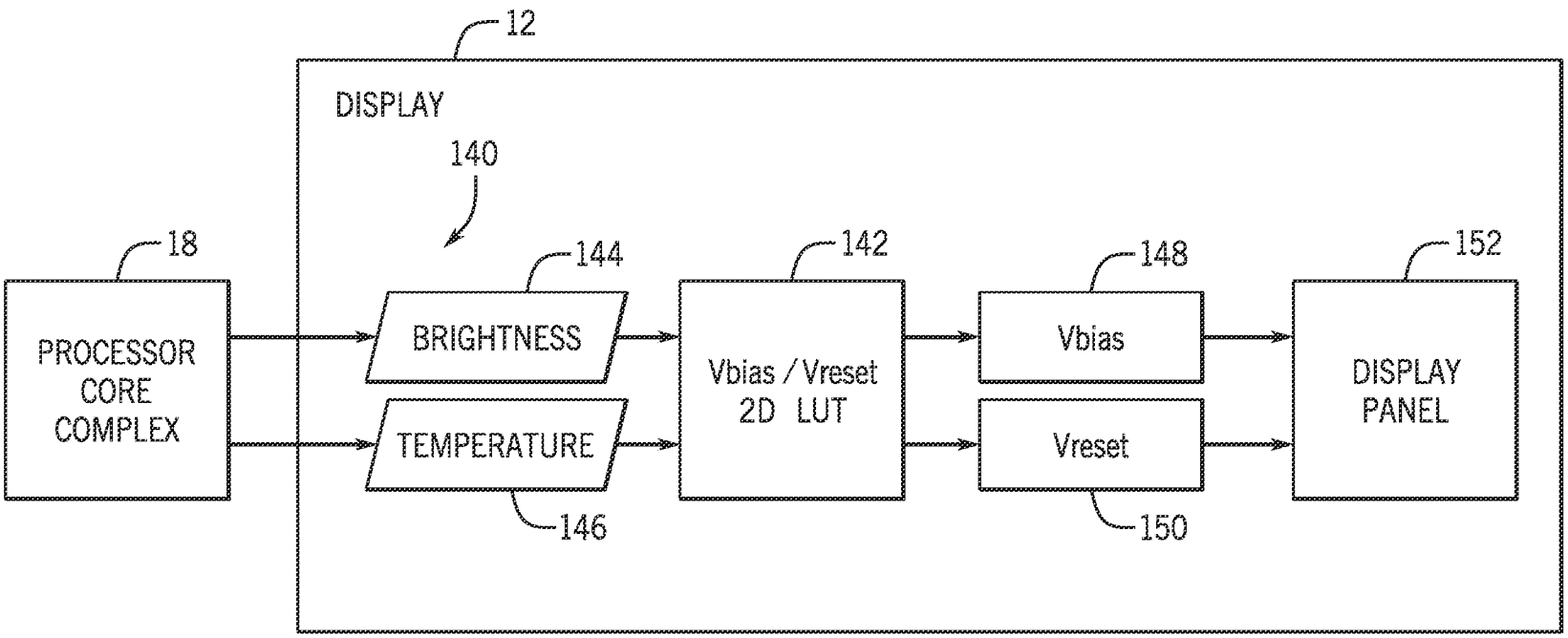
FIG. 13 is a block diagram of the selection circuitry for obtaining a sequence of dynamic bias voltages depending on parameters such as display brightness or temperature, in accordance with an embodiment.

The particular sequence of Vbias and Vreset that are applied to different subframes may be determined through any suitable calibration and stored for future access by the electronic display 12. In an example shown in FIG. 13, a driver integrated circuit (DIC) 140 of the electronic display 12 may store values of Vbias and Vreset in a lookup table (LUT) 142. The values of Vbias and Vreset may vary depending on a variety of factors. For example, the DIC 140 may receive an indication of a current brightness 144 (e.g., a current global display brightness setting, an average brightness of content being prepared for the electronic display 12) and a current temperature 146 of the electronic display 12 from any suitable source (e.g., the processor core complex 18 and/or components of the electronic display 12). The LUT 142 may index the brightness 144 and temperature 146 to find a Vbias sequence 148 and a Vreset sequence 150 to be supplied to the bias voltage supplies 78 and 82 (shown in FIG. 7) on a display panel 152 that includes the display pixels 54.

The particular Vbias sequences 148 and Vreset sequences 150 that are programmed into the LUT 142 may be determined through any suitable calibration. For example, an optimal value of Vbias and Vreset may be determined for each display panel 152 during manufacturing at a particular default temperature and brightness. This may be done by testing which values of Vbias and Vreset result in the most uniform light emission across subframes. A more general function that takes into account the effect of temperature and brightness (and/or any other suitable desired parameters) may be determined for a larger group of display panels 152 or determined per-panel, as well. The optimal per-panel values of Vbias and Vreset may be applied to the general function taking into account temperature and brightness and stored in the LUT 142.

These values may be stored as sequences of Vbias and Vreset (e.g., which may vary from subframe to subframe to result in more luminance uniformity among subframes) or as single values. In some examples, the LUT 142 may additionally index a present number (e.g., first subframe, second subframe, third subframe, and so forth) of the subframe to be displayed. In this way, the LUT 142 may output a first set of Vbias and Vreset values for a first subframe, a second set of Vbias and Vreset values for a second subframe, and so forth. In another example, if single values of Vbias and Vreset are stored, these may be applied to the display pixels 54 as single values or as sequences based on some scaling function. For example, base values of Vbias and Vreset may be output by the LUT 142 and then scaled by some amount depending on the subframe. There may be a first scaling factor for the initial active subframe 90, a second scaling factor for a first subsequent blanking subframe 92, a third scaling factor for the next blanking subframe 92, and so forth. These scaling values may be different for Vbias and Vreset. In other examples, the processor core complex 18 may directly instruct the DIC 140 which values of Vbias 148 and Vreset 150 to use.

Figure 14:
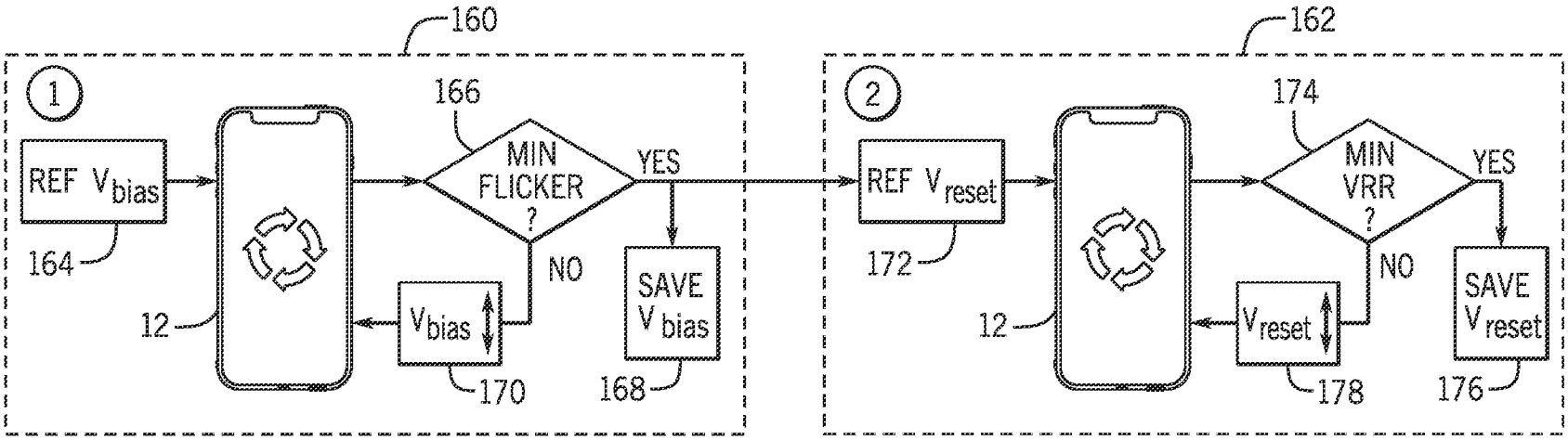
FIG. 14 is a flow diagram of a method for rapidly calibrating an electronic display with dynamic voltage tuning to reduce or eliminate flicker and variable refresh rate luminance difference artifacts, in accordance with an embodiment.

One manner of rapidly calibrating an electronic display 12 by identifying potentially optimal values of Vbias and Vreset during manufacturing is shown in a flow diagram of FIG. 14. Here, Vbias is determined during a first phase 160 and Vreset is determined in a second phase 162. Determining Vbias and Vreset in this order may increase the efficiency of determining these values, but it should be understood that other methods may reverse the order of these phases. As shown in FIG. 14, the first phase 160 may begin as an initial reference bias voltage Vbias (block 164) is tested on the bias voltage supply 78 on the electronic display 12 at one refresh rate or at several refresh rates. If the currently tested bias voltage Vbias causes a sufficiently minimal value of flicker on the electronic display 12 (decision block 166), the currently tested value of Vbias may be stored (block 168) (e.g., in nonvolatile memory, in the LUT 142). The flicker value may be determined, for example, using a sufficiently sensitive camera or light sensor. A sufficiently minimal value of flicker may be any value beneath some threshold of human perceptibility or the lowest value of flicker across a range of tested Vbias values. If the flicker value is not sufficiently minimal (decision block 166), the currently tested bias voltage Vbias may be adjusted up or down (e.g., according to any suitable optimization function or algorithm) (block 170) until a sufficiently minimal flicker value occurs.

Having obtained a satisfactory value of Vbias in the first phase 160, a satisfactory value of Vreset may be found in the second phase 162. The second phase 162 may begin as an initial reference bias voltage Vreset (block 172) is tested on the bias voltage supply 82 on the electronic display 12 at several refresh rates. If the currently tested bias voltage Vreset causes a sufficiently minimal value of variable refresh rate luminance difference on the electronic display 12 (decision block 174), the currently tested value of Vbias may be stored (block 176) (e.g., in nonvolatile memory, in the LUT 142). The variable refresh rate luminance difference value may be determined, for example, using a sufficiently sensitive camera or light sensor. A sufficiently minimal value of variable refresh rate luminance difference may be any value beneath some threshold of human perceptibility or the lowest value of variable refresh rate luminance difference across a range of tested Vreset values. If the variable refresh rate luminance difference value is not sufficiently minimal (decision block 174), the currently tested bias voltage Vreset may be adjusted up or down (e.g., according to any suitable optimization function or algorithm) (block 178) until a sufficiently minimal variable refresh rate luminance difference value occurs.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. An electronic device comprising:

a display pixel;

a first bias voltage supply configured to supply a first bias voltage corresponding to a first subframe of a frame of image data to the display pixel and supply a second bias voltage corresponding to a second subframe of the frame of image data to the display pixel, wherein the first bias voltage differs from the second bias voltage; and a reset bias voltage supply configured to supply a first reset bias voltage corresponding to the first subframe of the frame of image data to the display pixel and supply a second reset bias voltage to the second subframe of the of the frame of image data to the display pixel, wherein the first reset bias voltage differs from the second reset bias voltage.

2. The electronic device of claim 1, wherein:

the display pixel comprises a driving transistor that exhibits at least part of the hysteresis or an organic light emitting diode (OLED) that exhibits at least part of a hysteresis of the display pixel that varies between the first subframe and the second subframe, or both; or the first bias voltage supply is configured to supply the first bias voltage and the second bias voltage to bias a source or a drain of the driving transistor, or both; or the second bias voltage supply is configured to supply the first reset bias voltage and the second reset bias voltage as anode reset voltages to an anode of the OLED; or any combination thereof.

3. The electronic device of claim 2, wherein the display pixel comprises the driving transistor that exhibits at least part of the hysteresis that varies between the first subframe and the second subframe, and wherein the first bias voltage and the second bias voltage are configured to counteract the hysteresis.

4. The electronic device of claim 2, wherein the display pixel comprises the OLED that exhibits at least part of the hysteresis that varies between the first subframe and the second subframe, and wherein the first reset bias voltage and the second reset bias voltage are configured to counteract the hysteresis.

5. The electronic device of claim 2, wherein the display pixel comprises a driving transistor, wherein the first bias voltage supply is configured to supply the first bias voltage and the second bias voltage to bias a source of the driving transistor.

6. The electronic device of claim 2, wherein the display pixel comprises a driving transistor, wherein the first bias voltage supply is configured to supply the first bias voltage and the second bias voltage to a drain of the driving transistor.

7. The electronic device of claim 2, wherein the display pixel comprises the OLED, wherein the first bias voltage supply is configured to supply the first bias voltage and the second bias voltage as anode reset voltages to an anode of the OLED.

8. The electronic device of claim 2, wherein the display pixel comprises the driving transistor and the OLED, wherein the first bias voltage supply is configured to supply the first bias voltage and the second bias voltage as a bias voltage to the driving transistor and the reset bias voltage supply is configured to supply the first reset bias voltage and the second reset bias voltage as an anode reset voltage to the anode of the OLED.

9. The electronic device of claim 1, wherein the second subframe is directly sequential to the first subframe.

10. The electronic device of claim 1, wherein the first bias voltage supply is configured to supply a third bias voltage corresponding to a third subframe of the frame of image data to the display pixel.

11. The electronic device of claim 1, comprising a memory to store one or more values of the first bias voltage, wherein the one or more values are determined according to a method comprising:

(1) displaying, on an electronic display comprising a plurality of display pixels that include the display pixel and that include respective driving transistors and light emitting diodes, a frame of image data over a series of subframes, wherein a value of the first bias voltage is applied to the driving transistors or the light emitting diodes in between subframes;

(2) measuring an appearance of a first artifact on the electronic display;

in response to determining that the appearance of the first artifact on the electronic display is not within a threshold, repeating at least (1) and (2) using a different value of the first bias voltage; and in response to determining that the appearance of the first artifact on the electronic display is within the threshold, storing the value of the first bias voltage to enable the electronic display to use the value of the first bias voltage in operation.

12. The electronic device of claim 11, wherein the first artifact on the electronic display comprises a flicker artifact.

13. The electronic device of claim 11, wherein displaying the frame of image data over the series of subframes comprises displaying the image data at a plurality of different refresh rates, and wherein the first artifact on the electronic display comprises a variable refresh rate luminance difference.

14. The electronic device of claim 11, wherein the method comprises:

(3) displaying, on the electronic display, another frame of image data over another series of subframes, wherein the value of the first bias voltage is applied to the driving transistors and a value of a second bias voltage is applied to the light emitting diodes in between subframes;

(4) measuring an appearance of a second artifact on the electronic display;

in response to determining that the appearance of the second artifact on the electronic display is not within the threshold, repeating at least (3) and (4) using a different value of the second bias voltage; and in response to determining that the appearance of the second artifact on the electronic display is within the threshold, storing the value of the second bias voltage to enable the electronic display to use the value of the second bias voltage in operation.

15. The electronic device of claim 14, wherein the value of the first bias voltage and the value of the second bias voltage are stored in a lookup table in memory disposed in a display driver integrated circuit of the electronic display.

16. The electronic device of claim 1, comprising:

memory storing a lookup table configured to index a brightness setting of an electronic display that includes the display pixel, a temperature of the electronic display, or both and output a value of the first bias voltage to be supplied to the display pixel.

17. The electronic display of claim 16, comprising a second bias voltage supply configured to supply a second bias voltage to the display pixel, wherein the lookup table is configured to index the brightness setting of the electronic display and the temperature of the electronic display and output a value of the first bias voltage and a value of the second bias voltage.

18. The electronic display of claim 16, wherein the lookup table is configured to output a plurality of values of the first bias voltage to be supplied to the display pixel for a corresponding plurality of subframes of an image frame to be displayed on the electronic display.

* * * * *